US006820627B1

(12) United States Patent
Cordova

(10) Patent No.: US 6,820,627 B1
(45) Date of Patent: Nov. 23, 2004

(54) DIRECT FUEL INJECTOR CLEANER INJECTION DEVICE

(76) Inventor: Nelson Cordova, P.O. Box 7023, Los Angeles, CA (US) 90007

( * ) Notice: Subject to any disclaimer, the term of this patent is extended or adjusted under 35 U.S.C. 154(b) by 378 days.

(21) Appl. No.: 10/081,798

(22) Filed: Feb. 22, 2002

(51) Int. Cl.[7] ..... F02B 77/04; B08B 9/027

(52) U.S. Cl. ..... 134/110; 134/166 C; 134/169 A; 210/203; 123/198 A

(58) Field of Search ..... 134/110, 111, 134/169 A, 169 C, 166 C, 100.1; 210/198.1, 203; 123/1 A, 198 A

(56) References Cited

U.S. PATENT DOCUMENTS 4,784,170 A * 11/1988 Romanelli et al. ..... 134/113
5,257,604 A * 11/1993 Vataru et al. ..... 123/198 A
5,287,834 A * 2/1994 Flynn ..... 123/198 A
5,516,370 A * 5/1996 Karnauchow et al. ... 134/22.12
6,073,907 A * 6/2000 Schreiner et al. ..... 251/129.12
6,238,554 B1 * 5/2001 Martin et al. ..... 210/109
6,584,993 B1 * 7/2003 Chang ..... 134/169 A

* cited by examiner

*Primary Examiner*—Frankie L. Stinson
*Assistant Examiner*—Joseph Perrin
(74) *Attorney, Agent, or Firm*—Goldstein Law Offices, P.C.

(57) ABSTRACT

A fuel injector cleaner injection device for use with an automobile having an engine having a fuel injection system, a fuel supply, and a fuel line extending between the fuel supply and fuel injection system, the device having a main housing defining an interior volume, and a reservoir. The main housing has a fuel in port which is connected to the fuel line toward to the fuel supply, a fuel out port which is connected to the fuel line toward the engine, and a cleaner in port in communication with the reservoir through an adjustment valve. During use of the automobile, fuel flows from the fuel supply through the fuel in port through the interior volume to the fuel out port into the engine. Fuel injector cleaner from the reservoir is introduced into the fuel flow through the cleaner in port, under the control of the adjustment value.

7 Claims, 2 Drawing Sheets

DIRECT FUEL INJECTOR CLEANER INJECTION DEVICE

BACKGROUND OF THE INVENTION

The invention relates to a direct fuel injector cleaner injection device. More particularly, the invention relates to a device which is connected in-line with the fuel supply of an engine, and automatically mixes fuel injector cleaner with the fuel before it reaches the engine.

Since the mid '80s, fuel injection has largely replaced carburetion as a system for supplying fuel to the cylinders of internal combustion engines. With carbureted engines, gasoline had a tendency to "gum up" in time. However, since fuel injection employs plumbing having much smaller openings, both "gumming" of gasoline and impurities can easily clog fuel injection tubing and either reduce engine performance or cause cylinder "missing".

Accordingly, fuel injector cleaner is mandated by most automobile manufacturers to keep the injection system clean and purge impurities. However, adding fuel injector cleaner to gasoline requires regular action by the automobile owner. Such action is often forgotten, ignored, or neglected. Thus, the greater majority of automobiles having fuel injection systems are not maintained properly.

What is desired is a system which effectively cleans fuel injectors on a regular basis, but which does not require frequent intervention by the automobile owner.

Various manufacturers have included fuel filters which seek to eliminate or reduce fuel impurities, so that they do not reach the engine or fuel injection system. However, such filters are incapable of cleaning the inevitable clogging of fuel injectors. In fact, depending on the nature of the filter used, such filters can actually impeded fuel injector cleaner added to the gas tank from reaching the injectors.

While these units may be suitable for the particular purpose employed, or for general use, they would not be as suitable for the purposes of the present invention as disclosed hereafter.

SUMMARY OF THE INVENTION

It is an object of the invention to produce a fuel injector cleaner injection device which automatically and continuously adds fuel injector cleaner to the fuel supply in an automobile, so that fuel injector cleaning takes place whenever the automobile is in use. Accordingly, the device mixes fuel injector cleaner solution with the fuel before it reaches the engine.

It is a further object of the invention to provide a fuel injector cleaner injection device which adds fuel injector cleaner on a continual basis without frequent intervention by the automobile owner. Accordingly, the device installs "in-line", between the gas tank and/or fuel filter of the automobile and the engine. The device houses or attaches to a reservoir of fuel injector cleaner which is constantly mixed with the fuel supply before it reaches the engine.

It is a still further object of the invention to provide a fuel injector cleaner injection device which is adjustable by the user to control the rate of fuel injector cleaner injection and the relative mix of cleaner to fuel. Accordingly, the device has an adjustment valve for allowing varying degrees of injector cleaner to be mixed, to accommodate different engine and driving conditions, different grades of gasoline, and the like. The device can further be adjusted to enhance the flow of cleaner during periods of poor engine performance which is suspect of being related to clogging.

It is yet a further object of the invention to provide a fuel injector cleaner injection device which can itself filter impurities from the gasoline. Accordingly, the device has filters which mechanically remove impurities from the gasoline, to provide an extra level of protection, and to compensate for the lack of fuel filters in many automobiles.

The invention is a fuel injector cleaner injection device for use with an automobile having an engine having a fuel injection system, a fuel supply, and a fuel line extending between the fuel supply and fuel injection system, the device having a main housing defining an interior volume, and a reservoir. The main housing has a first side having a fuel in port which is connected to the fuel line as it extends to the fuel supply, a second side having a fuel out port which is connected to the fuel line as it extends to the engine, and a bottom wall having a cleaner in port in communication with the reservoir through an adjustment valve. During use of the automobile, fuel flows from the fuel supply through the fuel in port through the interior volume to the fuel out port into the engine. The reservoir contains fuel injector cleaner, which is selectively introduced into the fuel flow in the interior volume of the housing through the cleaner in port, under the control of the adjustment valve.

To the accomplishment of the above and related objects the invention may be embodied in the form illustrated in the accompanying drawings. Attention is called to the fact, however,that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
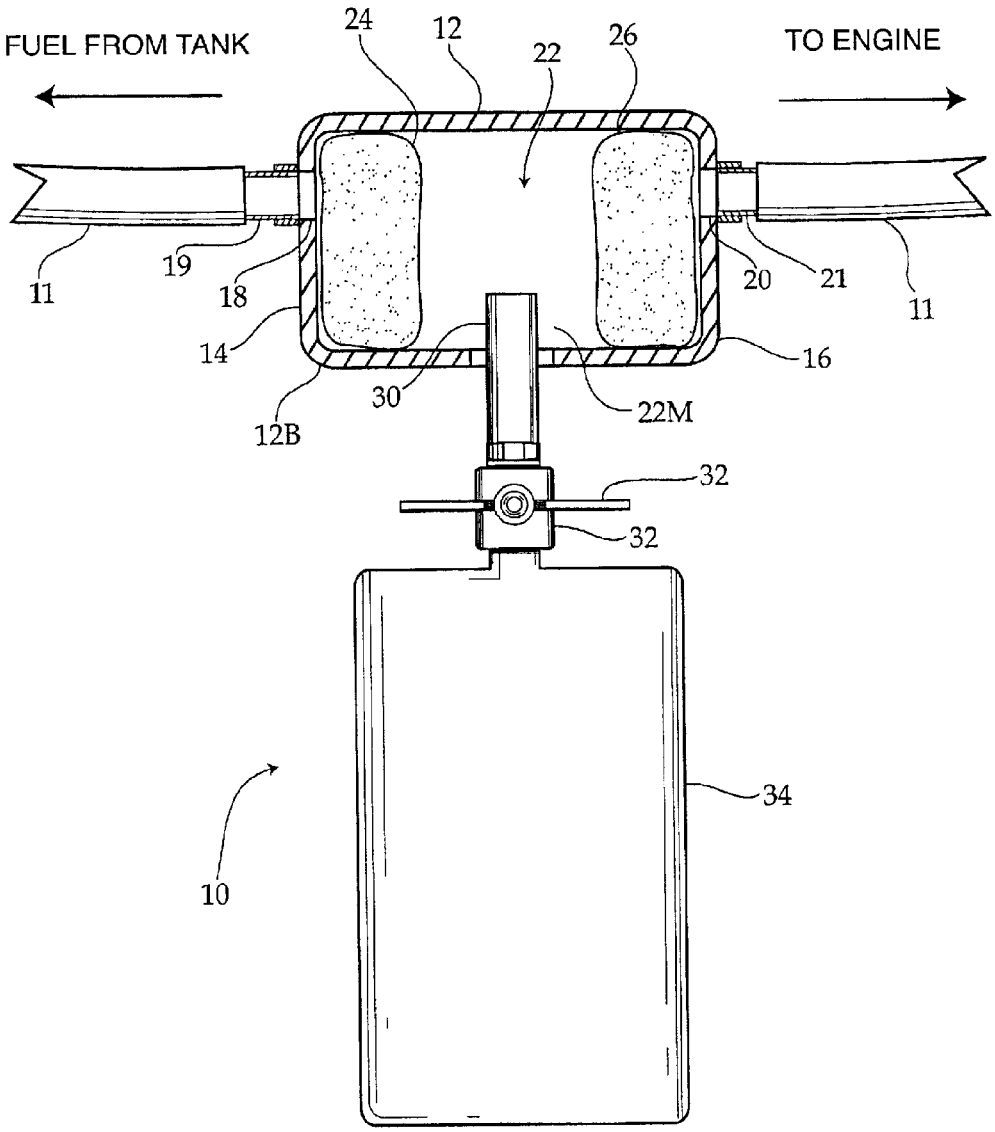
FIG. 1 is a front elevational view, with parts broken away, illustrating the fuel injector cleaner injection device, connected in-line between the fuel tank and fuel injection system of the engine.
Figure 2:
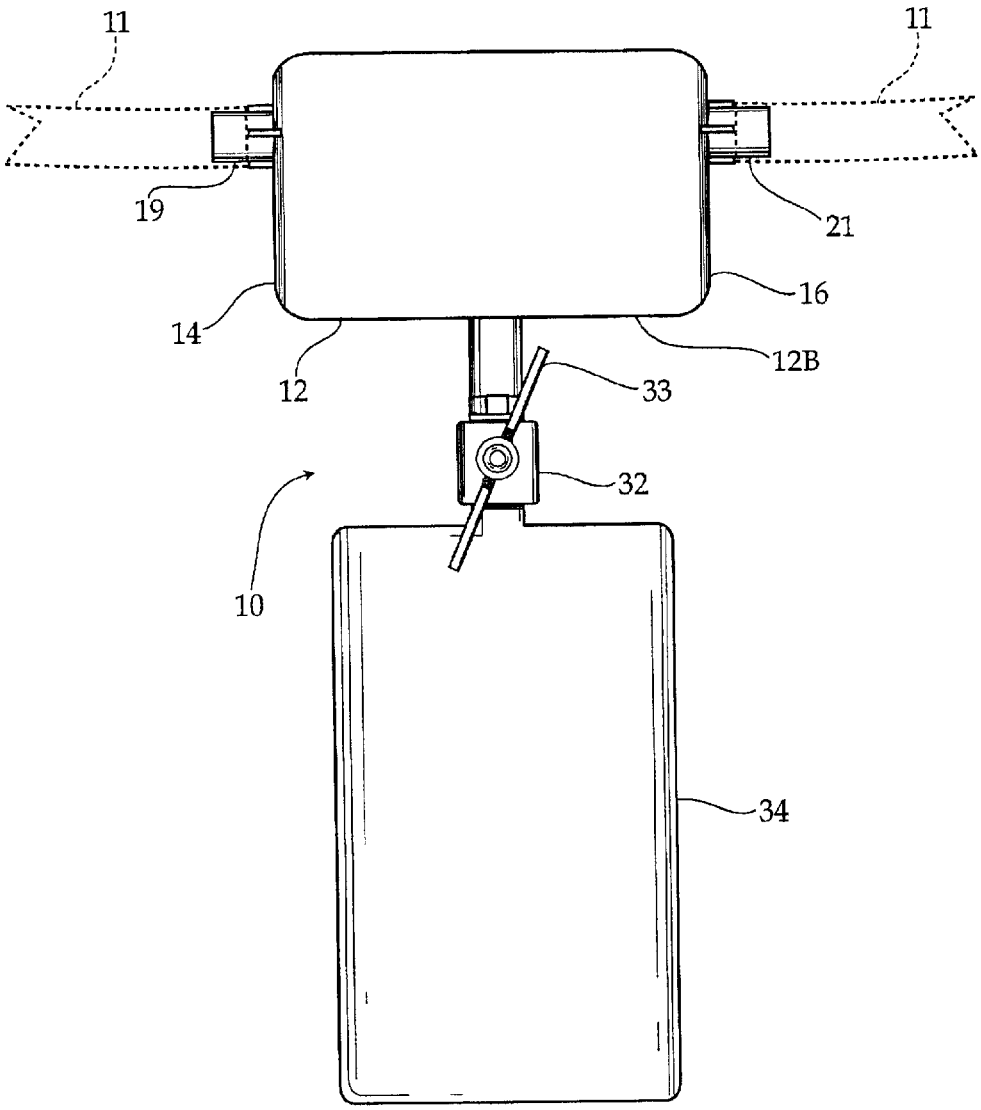
FIG. 2 is a front elevational view of just the injection device, wherein the adjustment valve has been operated to initiate flow of injector cleaner into the fuel.

FIG. 1 and FIG. 2 illustrates a fuel injector cleaner injection device 10, for use with an automobile having a fuel supply (gas tank), engine having a fuel injector system, and a fuel line 11 which connects the fuel supply with the engine. The device comprises a main housing 12 having a first side 14 and an opposite second side 16, a fuel in port 18 at the first side 14 and a fuel out port 20 at the second side. The main housing 12 is substantially closed, defining an interior volume 22 which is capable of containing a volume of fuel. As used herein, "fuel" typically refers to gasoline, but may refer to any other engine fuel. "Engine" generally refers to a gasoline internal combustion engine, but may refer to any other engine employing fuel injection technology or technology subsequently developed based thereon or closely related thereto.

The fuel in port 18 is in communication with the interior volume 22 at the first side 14, and the fuel out port 20 is in communication with the interior volume 22 at the second side 16. Typically, the first side 14 and second side 16 extend vertically. The fuel in port 18 has a fuel in port nipple 19 which allows connection to the fuel line 11 leading from the gas tank, or the standard fuel filter if one is provided in the automobile. The fuel out port 20 has a fuel out port nipple 21, which is connected to the fuel line 11 leading to the engine, or more particularly, to the fuel injection system of the engine. Generally then, fuel flows from the gas tank into the interior volume 22 through the in port 18 and out of the interior volume 22 through the out port 20 to the fuel injectors.

A first mechanical filter 24 is located within the interior volume 22, adjacent to the fuel in port 18, so that as fuel flows into the interior volume 22 it is selectively filtered by the first mechanical filter 24. The first mechanical filter 24 thereby provides a measure of filtration of particulate matter and other impurities according to the specific material used for the first mechanical filter 24.

A second mechanical filter 26 is located within the interior volume 22, adjacent to the fuel out port 20, so that before exiting the interior volume 22 and thus the device 10, an additional measure of filtration is provided to the fuel.

According to the present invention, a mid region 22M is created within the interior volume 22 between the first mechanical filter 24 and second mechanical filter 26 whereby all fuel passes in a fuel stream to reach the fuel out port 20. Further according to the present invention, a cleaner in port 30 is in communication with the mid region 22M. In particular, the housing 12 has a bottom wall 12B, extending substantially perpendicularly between the first side 14 and second side 16. The cleaner in port 30 is located at the bottom wall 12B and extends into the mid region 22M of the interior volume 22 slightly above the bottom wall 12B.

The cleaner in port 30 is connected to a cleaner reservoir 34 through an adjustment valve 32. The cleaner reservoir 34 contains a significant volume of fuel injector cleaner for injection into the fuel stream. The adjustment valve 32 allows effective control over whether fuel injector cleaner is injected into the fuel stream, and at what rate it is injected so as to directly control the mixture of fuel and fuel injector cleaner.

The reservoir 34 may be pressurized with fuel injector cleaner, wherein the adjustment valve 32 acts to restrict the natural expansion of the fuel injector cleaner outward through the cleaner in port 30 into the fuel stream. Accordingly, the reservoir 34 may be a replaceable can containing the fuel injector cleaner. Alternatively, with a proper configuration and venting well known to those of ordinary skill in the art, the reservoir 34 may contain non-pressurized fuel injector cleaner, which is sucked up or "inhaled" into the fuel stream by the venturi effect or by the very movement of the fuel stream across the cleaner in port 30. Accordingly, the adjustment valve 32 is fitted with suitable ball-valve or check valve apparatus necessary to prevent back flow of gasoline downward into the reservoir 34. The adjustment valve 32 may have a needle 33 which is rotated by the user to manipulate the adjustment valve 32.

For installation of the fuel injector cleaner injection device 10, fuel flow in the fuel line 11 is interrupted, and the fuel line is safely drained of fuel. The fuel line 11 is cut into two portions, and then the portion of the fuel line 11 extending from the gas tank or standard fuel filter is connected to the in port 18 and the in port nipple 19. The portion of the fuel line 11 extending to the engine is connected to the out port 20 at the out port nipple 21. The reservoir 34 is filled and/or connected to the cleaner in port 30. When vehicle operation is commenced and fuel flow through the housing 12 is established, the adjustment valve 32 is manipulated to begin injection of the fuel injection cleaner into the fuel stream in the interior volume 22. The adjustment valve 32 may then be suitably adjusted to either discontinue flow of cleaner, or to achieve a suitable flow of cleaner and mix with the fuel, as appropriate. In addition, mounting straps may be provided to secure the fuel injector cleaner injection device 10 to the engine, chassis, or any other suitable location.

In conclusion, herein is presented a system which attaches in-line within the fuel line of an existing vehicle, and allows fuel injector cleaner to be automatically injected into the fuel stream in a selective and controlled manner. The invention is illustrated and described by example in the attached drawings and foregoing description. However, the same is illustrative only of the numerous variations possible, while adhering to the inventive concept. Such variations are contemplated as being a part of the present invention.

What is claimed is:

1. A fuel injector cleaner injection device, for use with automobiles having a fuel tank, an engine having a fuel injection system, and a fuel line extending from the fuel tank to the fuel injection system, comprising:

a main housing defining an interior volume, the main housing having a first side and a second side, a fuel in port located at the first side for connection to the fuel line extending from the fuel tank, and a fuel out port located at the second side for connection to the fuel line extending to the engine, the housing further having a cleaner in port;

a first mechanical filter located within the main housing adjacent to the first side directly in front of the fuel in port so that fuel from the fuel in port must flow through the first mechanical filter;

a second mechanical filter located within the main housing adjacent to the second side directly in front of the fuel out port, a mid region located between the first mechanical filter and second mechanical filter, wherein fuel from the mid region must flow through the second mechanical filter to reach the fuel out port; and a reservoir of fuel injector cleaner, the reservoir in communication with the cleaner in port for supplying fuel injector cleaner into the mid region for mixing with gasoline flowing from the fuel in port to the fuel out port.

2. The fuel injector cleaner injection device as recited in claim 1, further comprising an adjustment valve interposed between the reservoir and cleaner in port, for controlling the flow of fuel injector cleaner into the mid region of the housing.

3. The fuel injector cleaner injection device as recited in claim 2, wherein fuel in port has a fuel in port nipple and the fuel out port has a fuel out port nipple to facilitate in-line attachment of the fuel injector cleaner injection device to a severed fuel line.

4. The fuel injector cleaner injection device as recited in claim 3, wherein the housing has a bottom wall extending substantially perpendicular to and between the first and second side walls, and wherein the cleaner in port extends through from the bottom wall upwardly into the fuel stream between the first mechanical filter and second mechanical filter.

5. A fuel injector cleaner injection device, for use with automobiles having a fuel tank, an engine having a fuel injection system, and a fuel line extending from the fuel tank to the fuel injection system severed into two portions, comprising:

a main housing defining an interior volume, the main housing having a first side, an opposite second side, and a bottom wall extending between the first side and second side, a fuel in port located at the first side and having a fuel in port nipple for connection to the portion of the fuel line extending from the fuel tank, and a fuel out port located at the second side having a fuel out port nipple for connection to the fuel line extending to the engine, the housing further having a cleaner in port extending into the interior volume upward from the bottom wall;

a first mechanical filter located within the main housing adjacent to the first side directly in front of the fuel in port so that fuel from the fuel in port must flow through the first mechanical filter; and a reservoir of fuel injector cleaner, the reservoir in communication with the cleaner in port for supplying fuel injector cleaner into the interior volume for mixing with fuel flowing from the fuel in port to the fuel out port.

6. The fuel injector cleaner injection device as recited in claim 5, further comprising an adjustment valve, interposed between the reservoir and the cleaner in port for controlling the flow of fuel injector cleaner into the interior volume.

7. The fuel injector cleaner as recited in claim 6, further comprising a second mechanical filter located within the main housing adjacent to the second side directly in front of the fuel out port, a mid region located between the first mechanical filter and second mechanical filter, the cleaner in port located in the mid region, wherein fuel from the mid region must flow through the second mechanical filter to reach the fuel out port.

* * * * *